US011773744B2

(12) United States Patent
Shi

(10) Patent No.: US 11,773,744 B2
(45) Date of Patent: Oct. 3, 2023

(54) SYSTEMS AND METHODS FOR CONTROLLING VANES OF AN ENGINE OF AN AIRCRAFT

(71) Applicant: THE BOEING COMPANY, Chicago, IL (US)

(72) Inventor: Fong Shi, Clyde Hill, WA (US)

(73) Assignee: THE BOEING COMPANY, Chicago, IL (US)

( * ) Notice: Subject to any disclaimer, the term of this patent is extended or adjusted under 35 U.S.C. 154(b) by 31 days.

(21) Appl. No.: 17/471,298

(22) Filed: Sep. 10, 2021

(65) Prior Publication Data

US 2022/0243607 A1 Aug. 4, 2022

Related U.S. Application Data

(60) Provisional application No. 63/143,137, filed on Jan. 29, 2021.

(51) Int. Cl.
*F01D 17/22* (2006.01)
*F01D 17/16* (2006.01)

(52) U.S. Cl.
CPC ..... *F01D 17/16* (2013.01); *F01D 17/22* (2013.01); *F05D 2220/323* (2013.01); *F05D 2240/12* (2013.01); *F05D 2260/60* (2013.01)

(58) Field of Classification Search
CPC ..... F01D 17/16; F01D 17/162; F01D 17/165; F01D 17/22; G11C 7/10; G11C 7/1051; G11C 7/1078; G11C 7/22; G11C 7/222; F05D 2270/60; F05D 2270/62; F05D 2270/64; F05D 2270/65; F05D 2270/66; F05D 2270/46
See application file for complete search history.

(56) References Cited

U.S. PATENT DOCUMENTS 7,438,027 B1 * 10/2008 Hinderks ..... F02B 75/32 123/197.1
10,443,509 B2 * 10/2019 Kay ..... F01D 21/12
2009/0097967 A1 * 4/2009 Smith ..... F04D 29/563 415/1
2010/0242492 A1 * 9/2010 Sloat ..... F02K 3/105 60/39.83
2013/0084179 A1 * 4/2013 Mantese ..... F01D 17/02 416/31
2017/0292400 A1 * 10/2017 Bifulco ..... F01D 17/085
2017/0363206 A1 * 12/2017 Bogen ..... H02K 7/116
(Continued)

OTHER PUBLICATIONS

Guissi, Sofiane, "Everything You Need to Knoe about FDSOI Technology—Advantages, Disadvantages, and Applications of FDSOI", Conventor, Jul. 20, 2018, https://www.conventor.com/blog/everything-you-need-to-know-about-fdsoi-technology-advantages-disadvantages-and-applications-of-fdsoi.

*Primary Examiner* — David E Sosnowski
*Assistant Examiner* — Maxime M Adjagbe
(74) *Attorney, Agent, or Firm* — The Small Patent Law Group LLC; Joseph M. Butscher

(57) ABSTRACT

A system and a method include an engine having one or more vanes. An actuator is coupled to the one or more vanes. The actuator is configured to move the one or more vanes between different positions. A control unit is coupled to the actuator. The control unit is configured to operate the actuator to move the one or more vanes between the different positions. The control unit is disposed on or within the engine.

20 Claims, 7 Drawing Sheets

(56) References Cited

U.S. PATENT DOCUMENTS

| | | | | |
|---|---|---|---|---|
| 2019/0201047 | A1* | 7/2019 | Yates | G16H 40/40 |
| 2019/0312153 | A1* | 10/2019 | Li | H01L 27/0805 |
| 2020/0180771 | A1* | 6/2020 | Moore | B64D 33/10 |
| 2020/0263560 | A1* | 8/2020 | Vesely | B64D 45/00 |

* cited by examiner

SYSTEMS AND METHODS FOR CONTROLLING VANES OF AN ENGINE OF AN AIRCRAFT

CROSS-REFERENCE TO RELATED APPLICATIONS

This application relates to and claims priority benefits from U.S. Provisional Application No. 63/143,137, entitled "Systems and Methods for Controlling Vanes of an Engine of an Aircraft," filed Jan. 29, 2021, which is hereby incorporated by reference in its entirety.

FIELD OF THE DISCLOSURE

Embodiments of the present disclosure generally relate to systems and methods for controlling vanes of an engine, such as an engine of an aircraft.

BACKGROUND OF THE DISCLOSURE

Various aircraft include propulsion systems, such as two or more engines. For example, certain aircraft include turbofan or turbojet engines having a plurality of fan blades coupled to an engine core.

Typical aircraft propulsion systems are typically operated through centralized control systems. In particular, a centrally located digital computer with analog and/or digital interface circuitry is used to communicate with remote actuators and sensors located throughout the aircraft via cables and wiring harnesses of various lengths, such as 100 feet or more.

Turbofan and turbojet engines include compressors having variable vane actuators. In accordance with the rotational speed and mass flow of a compressor, air intake is directed by the angle of one or multiple rows of stator vanes inside an air compressor. By adjusting the angles of the stator vanes via the variable vane actuator while engine spool is running, operation and fuel efficiency of the engine can be optimized under various flight conditions.

The variable vane actuator is a linear type, involving an electrohydraulic servo valve and a piston position sensor in a feedback loop. Outputs from the variable vane actuator are in the form of signals representing strokes and positions of the actuator.

To adjust the angles of the vanes, an existing electronic engine controller (EEC) that is remotely located from the engine sends drive commands for the position of the actuator over cables that connect the EEC to the actuator. To perform actuator position loop closure, positions and fault flags regarding the actuator are sent back to the EEC via separate cables. Sensor output typically must be sufficient to overcome noise coupled along the cables, which typically requires higher excitations in relation to the sensors. For a centralized dual redundant actuator system, more than twenty cables with over 20 volts of sensor excitations are typically needed.

As can be appreciated, the cables, wiring, connectors, and cable harnesses add size and weight to an aircraft. The increased size and weight reduce fuel efficiency. Additionally, the cables and connections between the actuators and EECs also increase manufacturing and maintenance time and costs. Further, the length of the cables can also lead to errors in control loops. Also, known systems typically require a relatively high level of drive (power) for sensor excitations. Also, known systems can lead to difficulty in detecting and isolating various faults with respect to wiring, valves, and sensors.

SUMMARY OF THE DISCLOSURE

A need exists for a system and a method for controlling vanes of an engine that reduces weight of an aircraft. Further, a need exists for a system and a method for controlling vanes that decrease manufacturing and maintenance time and costs. Also, a need exists for a system and a method for controlling vanes that are less prone to control errors. Additionally, a need exists for a system and a method for controlling vanes that can operate at lower power for sensor excitations. Moreover, a need exists for a system and a method for controlling vanes that are able to effectively and efficiently detect various system faults.

With those needs in mind, certain embodiments of the present disclosure provide a system including an engine (such as an engine of an aircraft) having one or more vanes. An actuator is coupled to the one or more vanes. The actuator is configured to move the one or more vanes between different positions. A control unit is coupled to the actuator. The control unit is configured to operate the actuator to move the one or more vanes between the different positions. The control unit is disposed on or within the engine.

For example, the control unit is secured to a housing of the engine. As another example, the control unit is mounted on the actuator. As another example, the control unit is disposed within the actuator.

In at least one embodiment, the control unit comprises at least one silicon-on-insulator (SoI) system-on-chip (SoC), such as, for example, a first SoI SoC, and a second SoI SoC. As a further example, the first SoI SoC is a digital fully depleted SoI, and the second SoI SoC is a mixed signal partially depleted SoI SoC.

In at least one embodiment, the first SoI SoC includes a microcontroller and an associated memory, a clock generator, a bus protocol interface circuit, a bus transceiver, and optionally a watchdog and fault log. Further, the second SoI SoC includes an analog-to-digital converter, a low voltage linear variable differential transducer (LVDT) excitation and demodulation unit, a solenoid driver, a multiplex switch, and a DC-DC power supply circuit.

In at least one embodiment, the system also includes a heat sink coupled to the control unit.

Certain embodiments of the present disclosure provide a method for controlling one or more vanes of an engine. The method includes coupling an actuator to the one or more vanes, wherein the actuator is configured to move the one or more vanes between different positions; and coupling a control unit to the actuator, wherein the control unit is configured to operate the actuator to move the one or more vanes between the different positions, wherein the control unit is on or within the engine.

DETAILED DESCRIPTION OF THE DISCLOSURE

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Certain embodiments of the present disclosure provide a system including one or more distributed variable vane actuator control units, such as controllers, on and/or within aircraft engines. In at least one embodiment, the controller(s) is co-located with one or more actuators coupled to the vanes. The controller(s) may include a silicon-on-insulator, system-on-chip, ceramic insulator, chip-on-heat sink, and/or the like, and may be configured for ratio-metric demodulation.

The distributed vane actuator controller located on or within the engine, such as directly coupled to the actuator, eliminates, minimizes, or otherwise reduces multiple, lengthy cable bundles, reduces power requirements for sensor excitation, and improves the ability to detect and isolate faults. Embodiments of the present disclosure allow for high-temperature operation at lower power levels. Such a distributed design, in contrast to known existing centralized control, permits notable improvements in size, weight, power, and fault isolation and repair.

Figure 1:
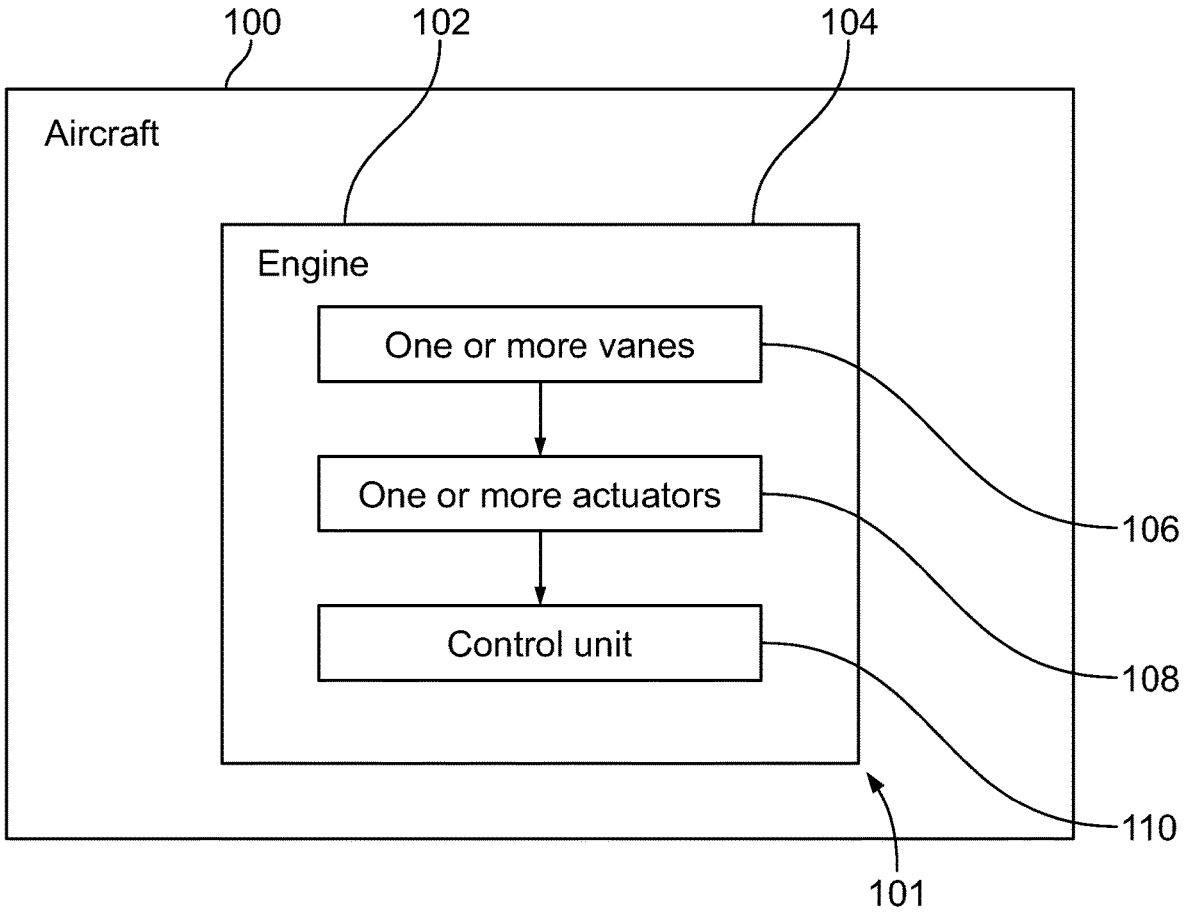
FIG. 1 illustrates a schematic block diagram of an aircraft having an engine, according to an embodiment of the present disclosure.

FIG. 1 illustrates a schematic block diagram of an aircraft 100 having an engine 102, according to an embodiment of the present disclosure. In at least one embodiment, the engine 102 is a turbofan or turbojet engine. The engine 102 includes a housing 104 containing one or more vanes 106, such as variable stator vanes. One or more actuators 108 are coupled to the one or more vanes 106. The one or more actuators 108 are configured to control movement of one or more vanes 106.

A control unit 110 is operatively coupled to the one or more actuators 108, such as through one or more wired or wireless connections. In at least one embodiment, the control unit 110 is or otherwise includes a distributed variable vane actuator controller. The control unit 110 is disposed on and/or within the engine 102. For example, the control unit 110 can be mounted on the housing 104. As another example, the control unit 110 can be mounted within the housing 104. In at least one embodiment, the control unit 110 is co-located with the one or more actuators 108. For example, in at least one embodiment, the control unit 110 is mounted on an actuator 108. As another example, the control unit 110 can be mounted within a housing of an actuator 108. By disposing the control unit 110 on or within the engine, such as on or within at least one of the actuators 108, a system 101 for controlling the one or more vanes 106 includes substantially less wiring, cables, harness, and/or the like, as compared to prior known systems, and leads to the aircraft 100 being lighter and more fuel efficient.

As described herein, embodiments of the present disclosure provide the system 101 for controlling the one or more vanes 106 of the engine 102. The system 101 includes the one or more actuators 108 coupled to the one or more vanes 106. The one or more actuators 108 are configured to move the one or more vanes between different positions, such as different angular positions within the engine 102. The control unit 110 is coupled to the one or more actuators 108 and is configured to control operation of the one or more actuators 108. The control unit 110 is disposed on or within the engine 102, instead of being remotely located from the engine 102.

As described herein, the system 101 includes the engine 102 having the one or more vanes 106. An actuator 108 is coupled to the one or more vanes 106. The actuator 108 is configured to move the one or more vanes 106 between different positions. The control unit 110 is coupled to the actuator 108. The control unit is configured to operate the actuator 108 to move the one or more vanes 106 between the different positions. The control unit 110 is disposed on or within the engine 102.

As used herein, the term "control unit," "central processing unit," "unit," "CPU," "computer," or the like may include any processor-based or microprocessor-based system including systems using microcontrollers, reduced instruction set computers (RISC), application-specific integrated circuits (ASICs), logic circuits, and any other circuit or processor including hardware, software, or a combination thereof capable of executing the functions described herein. Such are exemplary only, and are thus not intended to limit in any way the definition and/or meaning of such terms. For example, the control unit 110 may be or include one or more processors that are configured to control operation thereof, as described herein.

The control unit 110 is configured to execute a set of instructions that are stored in one or more data storage units or elements (such as one or more memories), in order to process data. For example, the control unit 110 may include or be coupled to one or more memories. The data storage units may also store data or other information as desired or needed. The data storage units may be in the form of an information source or a physical memory element within a processing machine.

The set of instructions may include various commands that instruct the control unit 110 as a processing machine to perform specific operations such as the methods and processes of the various embodiments of the subject matter described herein. The set of instructions may be in the form of a software program. The software may be in various forms such as system software or application software. Further, the software may be in the form of a collection of separate programs, a program subset within a larger program or a portion of a program. The software may also include modular programming in the form of object-oriented programming. The processing of input data by the processing machine may be in response to user commands, or in response to results of previous processing, or in response to a request made by another processing machine.

The diagrams of embodiments herein may illustrate one or more control or processing units, such as the control unit 110. It is to be understood that the processing or control units may represent circuits, circuitry, or portions thereof that may be implemented as hardware with associated instructions (e.g., software stored on a tangible and non-transitory computer readable storage medium, such as a computer hard drive, ROM, RAM, or the like) that perform the operations described herein. The hardware may include state machine circuitry hardwired to perform the functions described herein. Optionally, the hardware may include electronic circuits that include and/or are connected to one or more logic-based devices, such as microprocessors, processors, controllers, or the like. Optionally, the control unit 110 may represent processing circuitry such as one or more of a field-programmable gate array (FPGA), application-specific integrated circuit (ASIC), microprocessor(s), and/or the like. The circuits in various embodiments may be configured to execute one or more algorithms to perform functions described herein. The one or more algorithms may include aspects of embodiments disclosed herein, whether or not expressly identified in a flowchart or a method.

As used herein, the terms "software" and "firmware" are interchangeable, and include any computer program stored in a data storage unit (for example, one or more memories) for execution by a computer, including RAM memory, ROM memory, EPROM memory, EEPROM memory, and non-volatile RAM (NVRAM) memory. The above data storage unit types are exemplary only, and are thus not limiting as to the types of memory usable for storage of a computer program.

Figure 2:
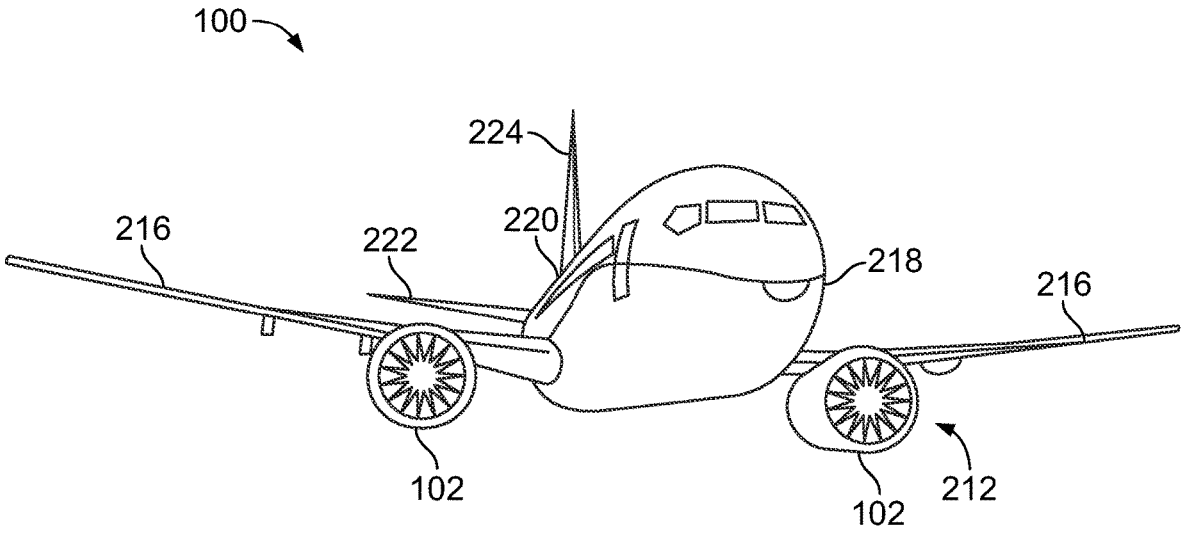
FIG. 2 illustrates a front perspective view of an aircraft, according to an exemplary embodiment of the present disclosure.

FIG. 2 illustrates a front perspective view of the aircraft 100, according to an exemplary embodiment of the present disclosure. The aircraft 100 includes a propulsion system 212 that includes two engines 102, for example, such as two turbofan or turbojet engines. Optionally, the propulsion system 212 may include more engines 102 than shown. The engines 102 are carried by wings 216 of the aircraft 100. In other embodiments, the engines 102 are carried by a fuselage 218 and/or an empennage 220. The empennage 220 may also support horizontal stabilizers 222 and a vertical stabilizer 224. The fuselage 218 of the aircraft 100 defines an internal cabin, including a flight deck.

Figure 3:
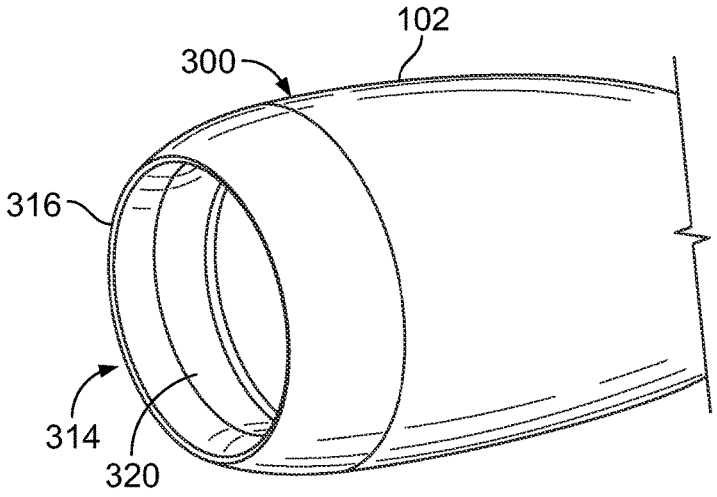
FIG. 3 illustrates a lateral perspective view of an engine, according to an embodiment of the present disclosure.

FIG. 3 illustrates a lateral perspective view of an engine 102, according to an embodiment of the present disclosure. In at least one embodiment, the engine 102 is a turbofan or turbojet engine having a case 300 that includes an engine inlet 314. The engine inlet 314 may include a leading edge 316 and an inner barrel section 320 located aft of the leading edge 316 of the engine inlet 314. The inner barrel section 320 may provide a boundary surface or wall for directing airflow (not shown) entering the engine inlet 314 and passing through the engine 102. The inner barrel section 320 may be located in relatively close proximity to one or more fan blades (not shown in FIG. 3). In this regard, the inner barrel section 320 may also be configured to serve as an acoustic structure having a plurality of perforations in an inner face sheet of the inner barrel section 320 for absorbing noise generated by the rotating fan blades and/or noise generated by the airflow entering the engine inlet 314 and passing through the engine 102.

Figure 4:
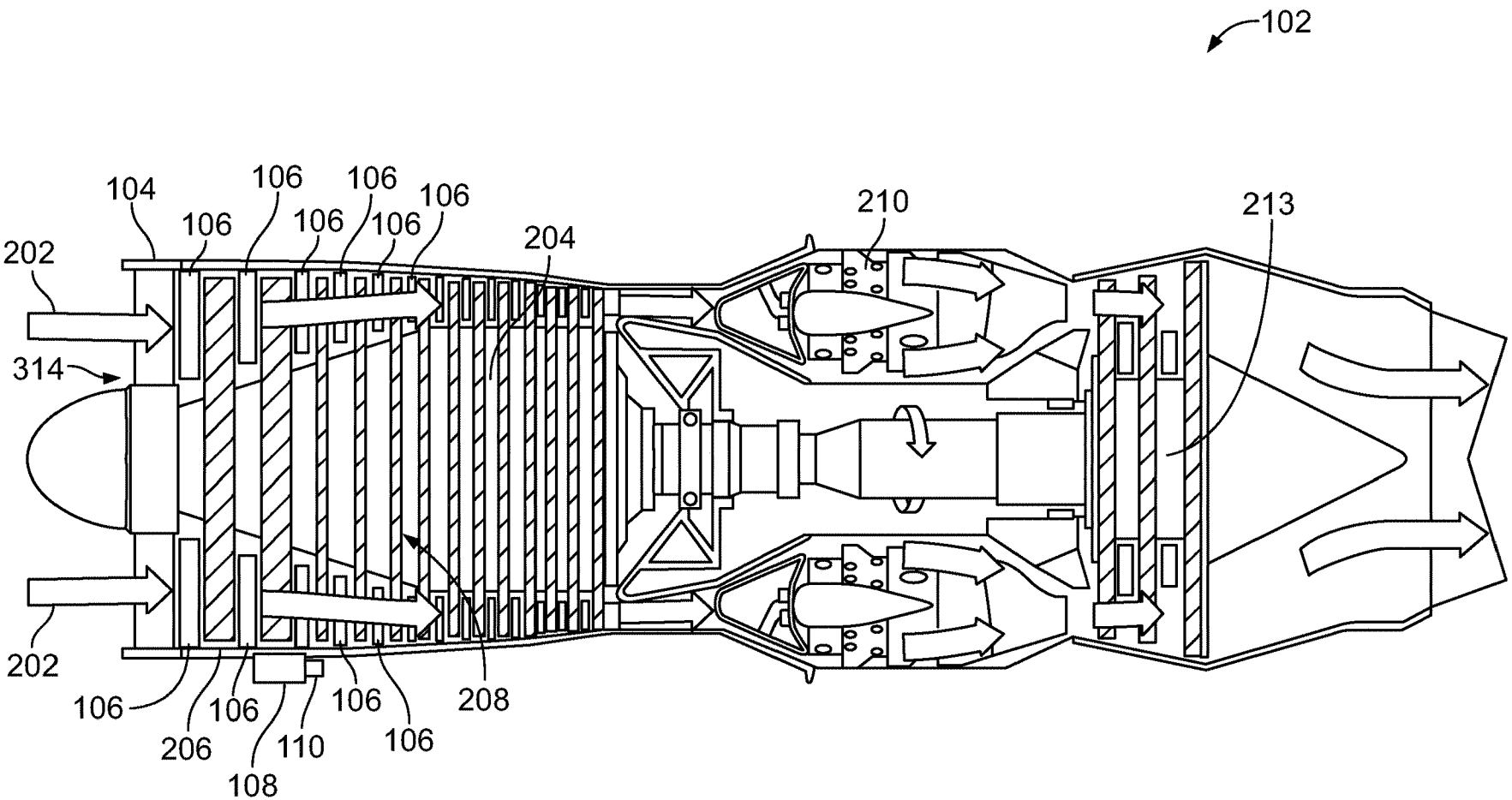
FIG. 4 illustrates a transverse cross-sectional view of the engine, according to an embodiment of the present disclosure.

FIG. 4 illustrates a transverse cross-sectional view of the engine 102, according to an embodiment of the present disclosure. The engine 102 includes a fan that draws air 202 into the engine inlet 314. A compressor 204 is downstream from the fan. A plurality of vanes 106 are coupled to a stator 206. The vanes 106 extend from the stator 206 and are disposed within an internal chamber 208, such as within and/or around portions of the compressor 204. A gas core 210 is downstream from the compressor 204. A turbine 213 is downstream from the gas core 210.

An actuator 108, such as a distributed vane actuator, is coupled to the plurality of vanes 106, and is configured to move the plurality of vanes 106 between various angular positions. The actuator 108 can be disposed on and/or within the housing 104.

The control unit 110 is coupled to the actuator 108. In at least one embodiment, the control unit 110 is co-located with the actuator 108. For example, the control unit 110 is mounted on and/or within the actuator 108. As shown, the control unit 110 is directly coupled to the actuator 108, such as being mounted on and/or within the actuator 108. The actuator 108 is not remotely located from the engine 102.

In operation, the air 202 that is drawn into the engine 102 is directed by the angular positions of the plurality of vanes 106. The actuator 108 adjusts the angles of the plurality of vanes 106 to optimize operation and fuel efficiency of the engine 102 under various flight conditions. Operation of the actuator 108 is controlled by the control unit 110.

Referring to FIGS. 1-4, by disposing the control unit 110, which controls vane actuation functions, proximate to (such as on, within, and/or adjacent) to the actuator(s) 108 and sensors, the system 101 reduces the length and weight of cable harnesses and power required for sensor excitation, while at the same time improving fault detection and isolation. The combustion process of an aircraft engine can increase air temperature from an ambient level to 650° C., and up to 1150° C. (such as within the gas core and/or in the turbine). While the air is compressed, the moving air inside the compressor may heat up to temperatures between 200° C. and 550° C. The control unit 110 operates in such conditions.

In at least one embodiment, the control unit 110 includes integrated circuits and discrete components. Electronic parts such as silicon-based integrated circuits of planar process for highly reliable aerospace applications operate up to ambient temperature of 125° C. In at least one embodiment, the control unit 110 includes silicon-on-insulator (SoI) components. Further, a planar silicon process can deliver the benefits of low leakage, high performance, and small size, plus radiation tolerance. Low leakage to silicon substrate improves circuit operation. Reduced capacitance allows faster switching at lower power.

A first SoI process is partially depleted SoI, which is used for high speed, low power, analog, and mixed-signal applications. A second SoI process is fully depleted SoI, which is used with ultra-thin buried oxide and very-thin silicon film, targeted for even higher speed at lower operating voltages, and is well-suited for digital applications. With low device leakages on an insulated substrate, SoI permits device operations at temperatures higher than its counterparts.

Further, using through-silicon-via or copper connections, stacked chips act like one device with one footprint. To achieve high levels of device integration, a concept known as system-on-chip (SoC) can be used.

With that in mind, the control unit 110 can be implemented with a minimum or reduced number of highly integrated parts. For example, the control unit 110 can include a digital SoC formed via the fully depleted SoI, and one mixed-signal SoC formed via the partially depleted SoI process.

In at least one embodiment, the control unit 110 includes one or more SoCs that are fabricated through an SoI process with complementary metal-oxide-semiconductor (CMOS) technology. A digital fully depleted SoI SoC integrates a microcontroller, memory, and I/O ports, as one part. Another mixed-signal partially depleted SoI SoC contains a switching power supply controller and all analog sensor interface circuitries.

Figure 5:
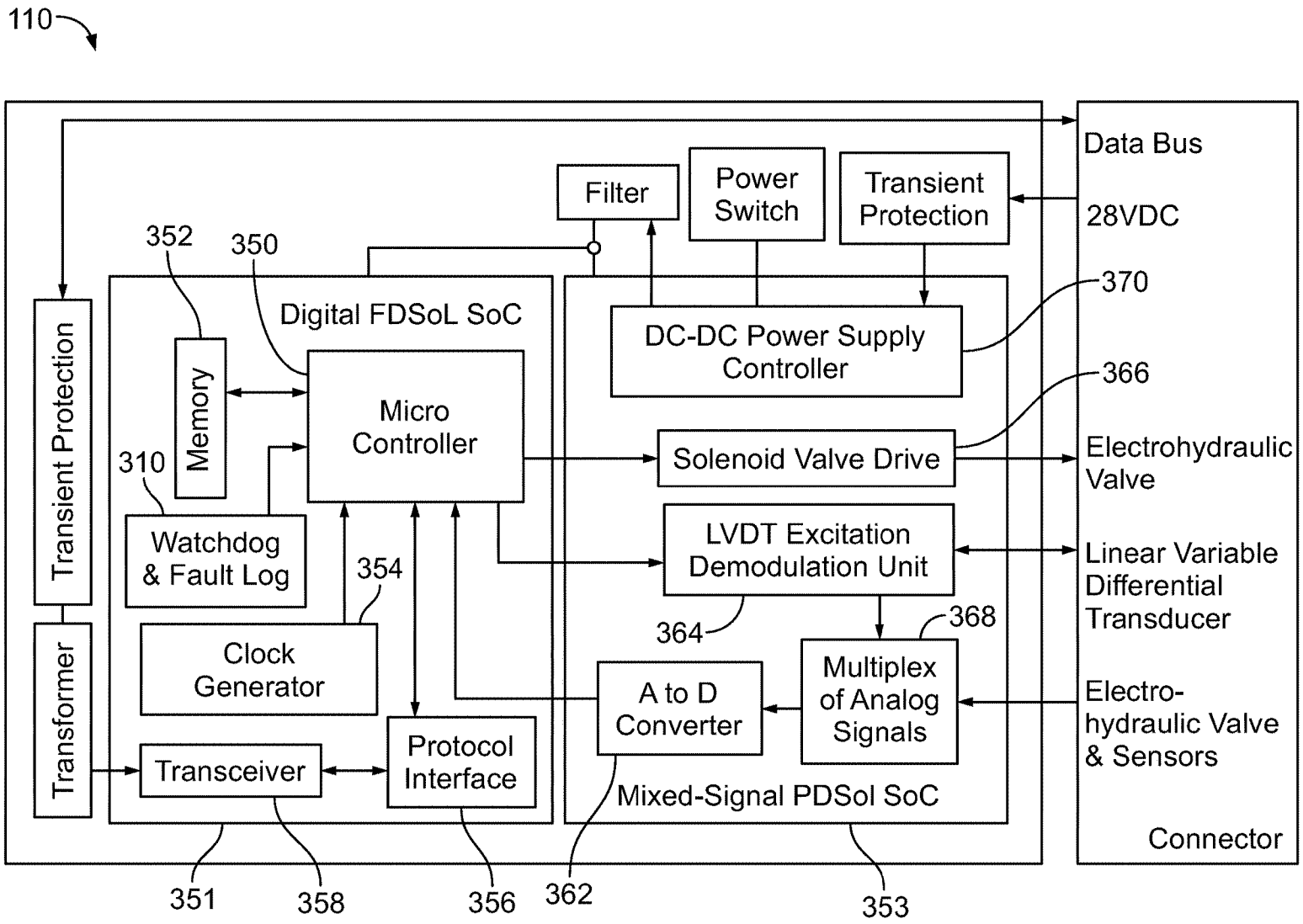
FIG. 5 illustrates a schematic block diagram of a control unit, according to an embodiment of the present disclosure.

FIG. 5 illustrates a schematic block diagram of the control unit 110, according to an embodiment of the present disclosure. In at least one embodiment, the control unit 110 includes a first SoI SoC and a second SoI SoC. For example, the control unit 110 can include a digital fully depleted SoI SoC 351 and a mixed-signal partially depleted SoI SoC 353. In at least one embodiment, the digital fully depleted SoC 351 includes a microcontroller 350 and an associated memory 352, a clock generator 354 for internal timing, supervisory and bus communications, a protocol interface, such as bus protocol interface circuit 356, a bus transceiver 358 for transmitting and receiving digital data, and a watchdog and fault log 360.

The mixed-signal partially depleted SoI SoC 353 includes an analog-to-digital converter 362 for digitizing incoming analog sensor signals, a low voltage linear variable differential transducer (LVDT) excitation and demodulation unit 364 with a 6 V drive (instead of 24V drive), a solenoid valve driver 366 for an electrohydraulic valve, a multiplex switch 368 configured to switch among several analog signals from sensors, and a DC-DC power supply controller 370.

Additional discrete parts can include a power metal-oxide-field-effect-transistor (MOSFET), filter capacitors such as stacked-up ceramic type capacitors, transient protection devices such as voltage clamps and energy absorbing metal-oxide-varistors (MOVs), transformers for isolation, voltage conversion and data coupling, and/or the like.

An LVDT is essentially a transformer having one primary winding and two secondary windings. A sinusoidal input excitation is applied to the primary and the output signals and represents the difference of the signals across the two secondary windings. The output signals indicate the positions of a magnetically coupled core sliding inside the LVDT. Conventional LVDT control systems use the difference between two generated voltage signals against a sinusoidal reference voltage signal that excites a primary signal of the LVDT, which is commonly referred to as LVDT demodulation. The LVDT excitation and demodulation unit 364 measures then processes the position signals, in the form of amplitude modulation with respect to the excitation voltage signal, namely reference (Ref). A synchronous demodulator rectifies such amplitude and uses low-pass filters to remove the carrier frequencies, which adds delays to the feedback loop. Given the sinusoidal excitation voltage Ref, the sum of the two secondary voltages is relatively constant. Results from the sum divided by Ref can be used to monitor the health status of internal coils of the LVDT, should the voltage sum deviate from normal thresholds.

In field applications, there can be certain errors that alter the actual signal, such as by a factor of k. Such variations come from fluctuations of the supply voltages, excitations, surrounding temperatures, and noise picked up by long cable runs, among others. Copper conductor, for example, has a known temperature coefficient of about 0.4%/° C. The demodulator circuit also has an initial offset, or bias, that deviates from zero at a center null position of the LVDT, referred to as b.

A traditional LVDT Demodulation (DEM) result of Y is proportional to the error factor k, $$Y(\mathrm{DEM}) \approx (kA+b)-(kB+b)=k(A-B)$$

Note that for an absolute measurement, the initial bias is canceled out, but the demodulation result still has a k factor.

Ratio-metric Demodulation (RD) measures a signal in a form of a ratio.

The ratio is the signal of interest with respect to another signal of the same type. The result of the RD method in this case is as follows:

$$Y(RD) \approx \frac{(kA+b)-(KB+b)}{(kA+b)+(KB+b)} = \frac{k(A-B)}{k(A+B)+2b} = \frac{(A-B)}{(A+B)+\left(\frac{2b}{k}\right)}$$

A factor 2b/k appears as an additional term in the denominator of the operation, which minimizes or otherwise reduces the effect of error factor k, in comparison with the traditional demodulation operation described above.

Figure 6:
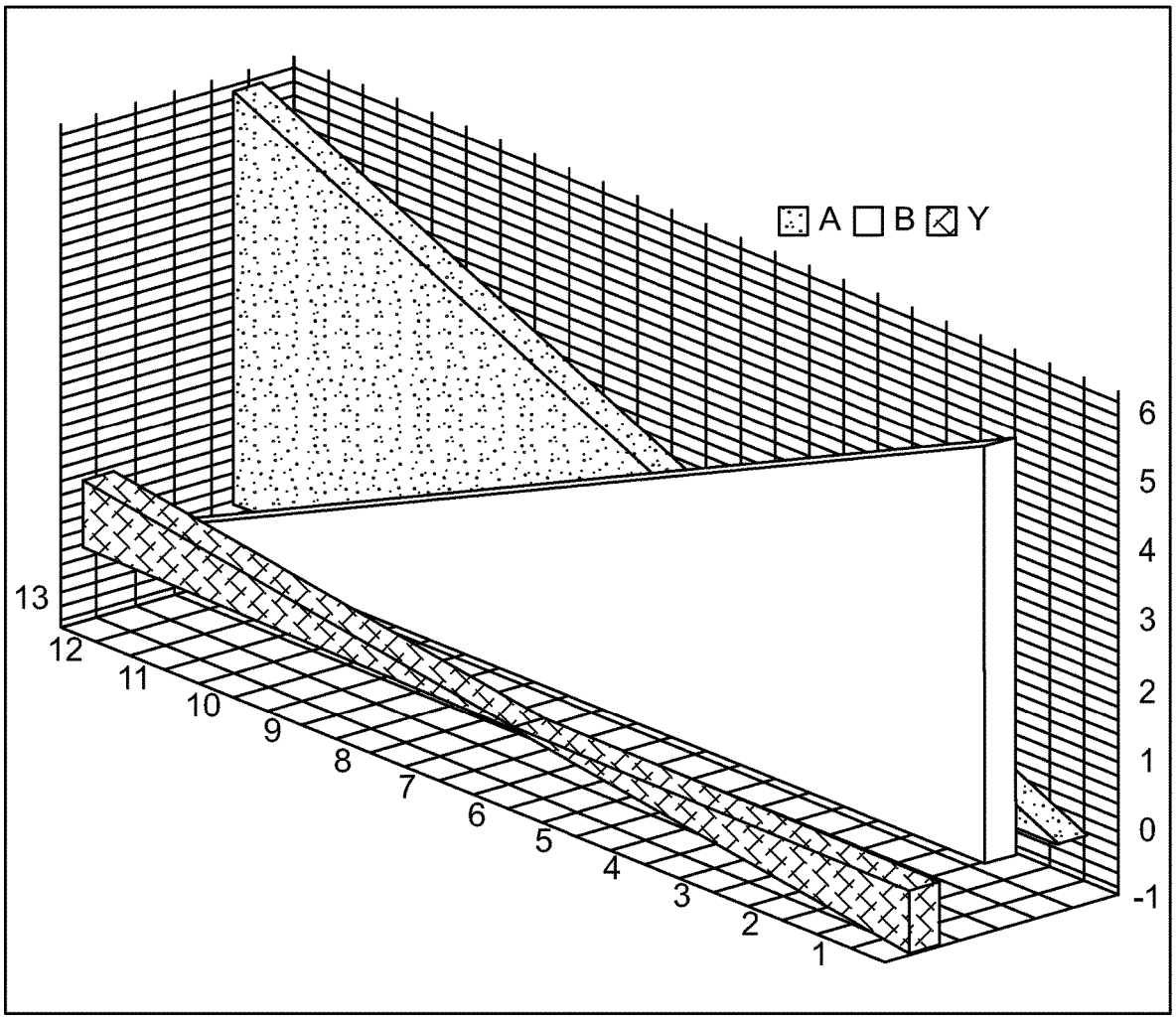
FIG. 6 illustrates a chart of ratio-metric demodulation of linear variable differential transducer positions.

FIG. 6 illustrates a chart of ratio-metric demodulation of LVDT positions. As shown, Y(RD) varies from −1 to +1 linearly while A and B vary from 0 to 6 in a full scale. Assuming an LVDT demodulator has maximum error of 1% and 10 mV offset over its full scale of 6V, then k=1+0.01=1.01, and b=0.010V. The delta (difference) in percentage of the traditional demodulator of synchronous rectification would be 0.01 or 1%, whereas the RD method is 0.0033 or 0.33%.

Figure 7:
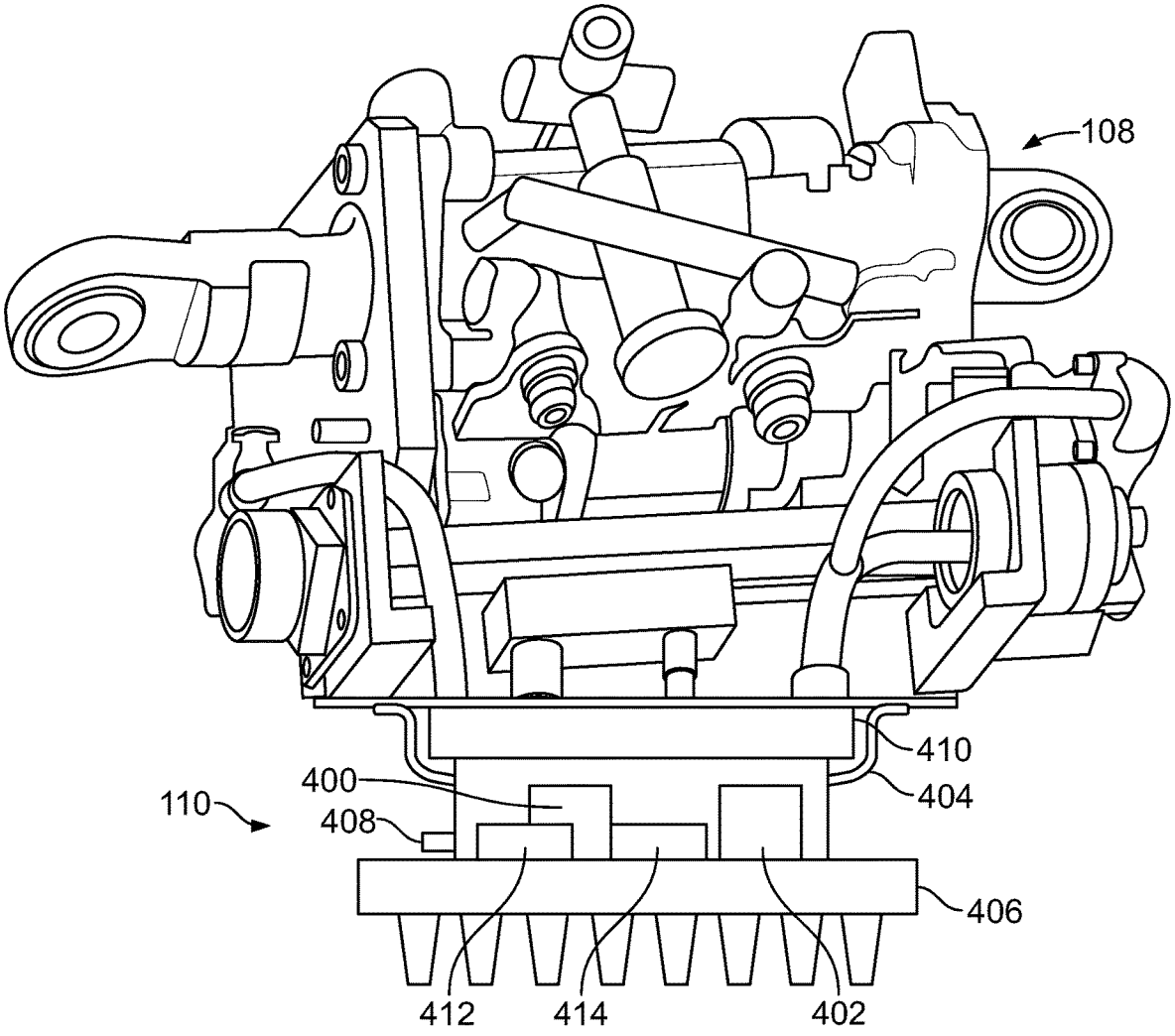
FIG. 7 illustrates a simplified diagram of a control unit coupled to an actuator, according to an embodiment of the present disclosure.

FIG. 7 illustrates a simplified diagram of the control unit 110 coupled to an actuator 108, according to an embodiment of the present disclosure. The control unit 110 shown in FIG. 7 is merely exemplary, and can include more or less components than shown. Further, the components can be formed of different materials and operate at different temperatures than those described. As an example, the control unit 110 can include transformers 400, wires, one or more capacitor stacks 402, solder paste, ground bond ties 404 (such as may ground the control unit 110 to an airframe), a metalized aluminum nitride (AlN) heat sink 406, an electrical insulator, a wire connector 408, power, ground return, data bus, LVDT and valve, a ceramic insulator 410 (such as amorphous silica fibers, zirconia, dense alumina $Al_2O_3$, silicon carbide SiC, or silicon nitride Si3N), the first SoI Soc 412, and the second SoI Soc 414.

To ensure the maximum junction temperature of SoC semiconductor devices of the SoI process does not exceed 150° C., thus allowing 5° C. for the temperature difference, the control unit 110 can be mounted at a location where temperature along the leading rows of stator vanes is at its lowest, such as around 200° C. Using ceramic as the material for the heat sink 406 ensures outstanding thermal conductivity and electrical insulation. Semiconductor chips can be directly attached to alumina or aluminum nitride heat sinks. The heat sink 406 removes the heat generated by the components inside, and the heat conducted from the actuator body via the ground bond ties 404, to ensure the control unit 110 temperature does not exceed 145° C.

For example, further away from the gas core 210 and turbine 213, temperature near the engine front where a stator vane actuator 108 is bolted can be lower, such as, about 200° C. Heat flows from hot to cool. The controller 110 is sandwiched between ceramic insulator 410 and heat sink 406. The insulator 410 is mounted on the actuator 110, but some of the heat will conduct via the grounding bond 404 before being dissipated by the heat sink 406. Heat generated by the components inside the actuator 110 also are dissipated by the heat sink 406. As an example, the temperature difference at the interface on which the components are attached is about 5° C. Further, temperature requirements of those semiconductor devices may not exceed 150° C., and the temperature of the heat sink 406 may not exceed 145° C. as moving (inlet) air passes over it.

As described herein, embodiments of the present disclosure provide systems and methods for controlling vanes of an engine that reduces weight of an aircraft. Further, the systems and methods decrease manufacturing and maintenance time and costs. Also, the systems and methods are less prone to control errors. Additionally, the systems and methods can operate at lower power for sensor excitations. Moreover, the systems and methods are able to effectively and efficiently detect various system faults.

Figure 8:
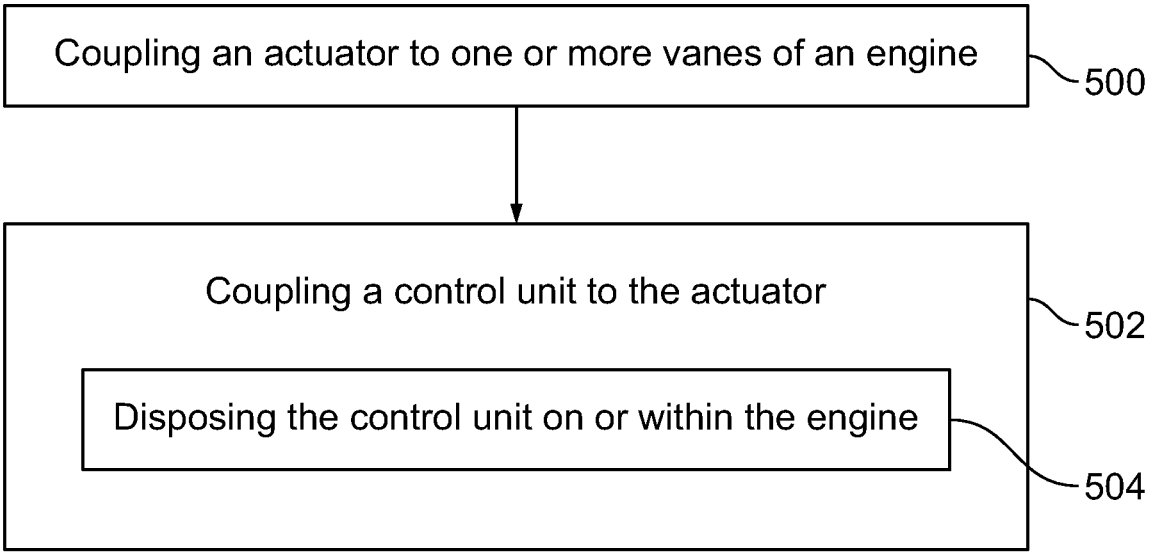
FIG. 8 illustrates a flow chart of a method for controlling one or more vanes of an engine, according to an embodiment of the present disclosure.

FIG. 8 illustrates a flow chart of a method for controlling one or more vanes of an engine, according to an embodiment of the present disclosure. The method includes coupling, at 500, an actuator to the one or more vanes, wherein the actuator is configured to move the one or more vanes between different positions; and coupling, at 502, a control unit to the actuator, wherein the control unit is configured to operate the actuator to move the one or more vanes between the different positions, wherein said coupling, at 502, the control unit includes disposing, at 504, the control unit on or within the engine.

In at least one embodiment, said disposing, at 504, includes securing the control unit to a housing of the engine. In at least one embodiment, said disposing, at 504, includes mounting the control unit on the actuator. In at least one other embodiment, said disposing, at 504, includes disposing the control unit within the actuator.

As an example, the method further includes providing the control unit with at least one silicon-on-insulator (SoI) system-on-chip (SoC).

The method can also include coupling a heat sink to the control unit.

Further, the disclosure comprises embodiments according to the following clauses:

Clause 1. A system comprising:

an engine having one or more vanes;

an actuator coupled to the one or more vanes, wherein the actuator is configured to move the one or more vanes between different positions; and a control unit coupled to the actuator, wherein the control unit is configured to operate the actuator to move the one or more vanes between the different positions, wherein the control unit is disposed on or within the engine.

Clause 2. The system of Clause 1, wherein the control unit is secured to a housing of the engine.

Clause 3. The system of Clause 1, wherein the control unit is mounted on the actuator.

Clause 4. The system of Clause 1, wherein the control unit is disposed within the actuator.

Clause 5. The system of any of Clauses 1-4, wherein the control unit comprises at least one silicon-on-insulator (SoI) system-on-chip (SoC).

Clause 6. The system of Clause 5, wherein the at least one SoI SoC comprises:

a first SoI SoC and a second SoI SoC.

Clause 7. The system of Clause 6, wherein the first SoI SoC is a digital fully depleted SoI, and the second SoI SoC is a mixed signal partially depleted SoI SoC.

Clause 8. The system of Clauses 6 or 7, wherein the first SoI SoC comprises:

a microcontroller and an associated memory;

a clock generator;

a bus protocol interface circuit; and a bus transceiver.

Clause 9. The system of any of clauses 6-8, wherein the second SoI SoC comprises:

an analog-to-digital converter;

a low voltage linear variable differential transducer (LVDT) excitation and demodulation unit;

a solenoid driver;

a multiplex switch; and a DC-DC power supply circuit.

Clause 10. The system of any of Clauses 1-9, further comprising a heat sink coupled to the control unit.

Clause 11. A method for controlling one or more vanes of an engine, the method comprising:

coupling an actuator to the one or more vanes, wherein the actuator is configured to move the one or more vanes between different positions; and coupling a control unit to the actuator, wherein the control unit is configured to operate the actuator to move the one or more vanes between the different positions, wherein the control unit is on or within the engine.

Clause 12. The method of Clause 11, wherein the control unit is secured to a housing of the engine.

Clause 13. The method of Clause 11, wherein the control unit is on the actuator.

Clause 14. The method of Clause 11, wherein the control unit is within the actuator.

Clause 15. The method of any of Clauses 11-14, wherein the control unit comprises at least one silicon-on-insulator (SoI) system-on-chip (SoC).

Clause 16. The method of Clause 15, wherein the at least one SoI SoC comprises:

a digital fully depleted SoI SoC and a mixed signal partially depleted SoI SoC.

Clause 17. The method of Clause 16, wherein the digital fully depleted SoI SoC comprises:

a microcontroller and an associated memory;

a clock generator;

a bus protocol interface circuit; and a bus transceiver.

Clause 18. The method of Clauses 16 or 17, wherein the mixed signal partially depleted SoI SoC comprises:

an analog-to-digital converter;

a low voltage linear variable differential transducer (LVDT) excitation and demodulation unit;

a solenoid driver;

a multiplex switch; and a DC-DC power supply circuit.

Clause 19. The method of Clause 11, further comprising a heat sink coupled to the control unit.

Clause 20. An aircraft comprising:

an engine having one or more vanes;

an actuator coupled to the one or more vanes, wherein the actuator is configured to move the one or more vanes between different positions;

a control unit coupled to the actuator, wherein the control unit is configured to operate the actuator to move the one or more vanes between the different positions; and a heat sink coupled to the control unit, wherein the control unit is disposed on or within the engine, and wherein the control unit comprises a digital fully depleted silicon-on-insulator (SoI) system-on-chip (SoC) and a mixed signal partially depleted SoI Soc.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A system comprising:

an engine having one or more vanes;

an actuator coupled to the one or more vanes, wherein the actuator is configured to move the one or more vanes between different positions; and a control unit coupled to the actuator, wherein the control unit comprises a ceramic insulator directly mounted on the actuator, and wherein the control unit is configured to operate the actuator to move the one or more vanes between the different positions, wherein the control unit is mounted on the actuator on or within the engine.

2. The system of claim 1, wherein the control unit is secured to a housing of the engine.

3. The system of claim 1, wherein the control unit comprises at least one silicon-on-insulator (SoI) system-on-chip (SoC).

4. The system of claim 3, wherein the at least one SoI SoC comprises:

a first SoI SoC; and a second SoI SoC.

5. The system of claim 4, wherein the first SoI SoC is a digital fully depleted SoI, and the second SoI SoC is a mixed signal partially depleted SoI SoC.

6. The system of claim 4, wherein the first SoI SoC comprises:

a microcontroller and an associated memory;

a clock generator;

a bus protocol interface circuit; and a bus transceiver.

7. The system of claim 6, wherein the second SoI SoC comprises:

an analog-to-digital converter;

a low voltage linear variable differential transducer (LVDT) excitation and demodulation unit;

a solenoid driver;

a multiplex switch; and a DC-DC power supply circuit.

8. The system of claim 1, further comprising a heat sink coupled to the control unit.

9. The system of claim 8, wherein the heat sink is a ceramic heat sink.

10. The system of claim 1, wherein the control unit further comprises one or more processors.

11. A method for controlling one or more vanes of an engine, the method comprising:

coupling an actuator to the one or more vanes, wherein the actuator is configured to move the one or more vanes between different positions; and coupling a control unit to the actuator, wherein the control unit comprises a ceramic insulator directly mounted on the actuator, and wherein the control unit is configured to operate the actuator to move the one or more vanes between the different positions, wherein the control unit is on the actuator on or within the engine.

12. The method of claim 11, wherein the control unit is secured to a housing of the engine.

13. The method of claim 11, wherein the control unit comprises at least one silicon-on-insulator (SoI) system-on-chip (SoC).

14. The method of claim 13, wherein the at least one SoI SoC comprises:

a digital fully depleted SoI SoC; and a mixed signal partially depleted SoI SoC.

15. The method of claim 14, wherein the digital fully depleted SoI SoC comprises:

a microcontroller and an associated memory;

a clock generator;

a bus protocol interface circuit; and a bus transceiver.

16. The method of claim 15, wherein the mixed signal partially depleted SoI SoC comprises:

an analog-to-digital converter;

a low voltage linear variable differential transducer (LVDT) excitation and demodulation unit;

a solenoid driver;

a multiplex switch; and a DC-DC power supply circuit.

17. The method of claim 11, further comprising a heat sink coupled to the control unit.

18. The method of claim 17, wherein the heat sink is a ceramic heat sink.

19. The method of claim 11, wherein the control unit further comprises one or more processors.

20. An aircraft comprising:

an engine having one or more vanes;

an actuator coupled to the one or more vanes, wherein the actuator is configured to move the one or more vanes between different positions;

a control unit coupled to the actuator, wherein the control unit comprises a ceramic insulator directly mounted on the actuator, and wherein the control unit is configured to operate the actuator to move the one or more vanes between the different positions;

a heat sink coupled to the control unit, wherein the control unit is mounted on the actuator on or within the engine, and wherein the control unit comprises a digital fully depleted silicon-on-insulator (SoI) system-on-chip (SoC), and a mixed signal partially depleted SoI Soc.

* * * * *